United States Patent [19]

Netsch, Jr.

[11] Patent Number: 4,651,993

[45] Date of Patent: Mar. 24, 1987

[54] DESIGN GAME AND MODULES FOR USE THEREIN

[76] Inventor: Walter A. Netsch, Jr., 1700 N. Hudson St., Chicago, Ill. 60611

[21] Appl. No.: 792,779

[22] Filed: Oct. 30, 1985

Related U.S. Application Data

[63] Continuation of Ser. No. 611,607, May 18, 1984, abandoned.

[51] Int. Cl.[4] ..... A63H 33/06

[52] U.S. Cl. ..... 273/157 R; 33/567; 52/311; 434/96; 446/86; 446/99

[58] Field of Search ..... 273/157 R; 33/518, 527, 33/567, DIG. 20; 52/311, 749, DIG. 1; 446/85, 86, 99, 100, 108, 111, 112; 434/96

[56] References Cited

U.S. PATENT DOCUMENTS

| | | | |
|---|---|---|---|
| 2,134,062 | 10/1938 | Trbojevich | 33/567 |
| 2,466,919 | 4/1949 | Sykes | 52/749 |
| 4,076,253 | 2/1978 | Eriksen | 273/157 R |
| 4,308,016 | 12/1981 | White | 273/157 R |
| 4,345,762 | 8/1982 | Lebelson | 273/157 R |

FOREIGN PATENT DOCUMENTS

| | | | |
|---|---|---|---|
| 286891 | 3/1953 | Switzerland | 273/157 R |

*Primary Examiner*—Anton O. Oechsle

*Attorney, Agent, or Firm*—Clement and Ryan

[57] ABSTRACT

A design game comprising at least six series of at least six modules each, each of the series being constituted of the same number of modules and all of the modules having the same shape in plan, with the area in plan of the modules of each series progressing in the same way as in every other series, from the smallest to the largest, according to a definite geometric formula. Modules in the shape of a square are specifically disclosed. The modules are used to form various abstract and quasi-representational designs. At least one spacer element may be used as an aid for positioning the modules relative to each other in a desired angular relationship.

11 Claims, 10 Drawing Figures

FIG. 1
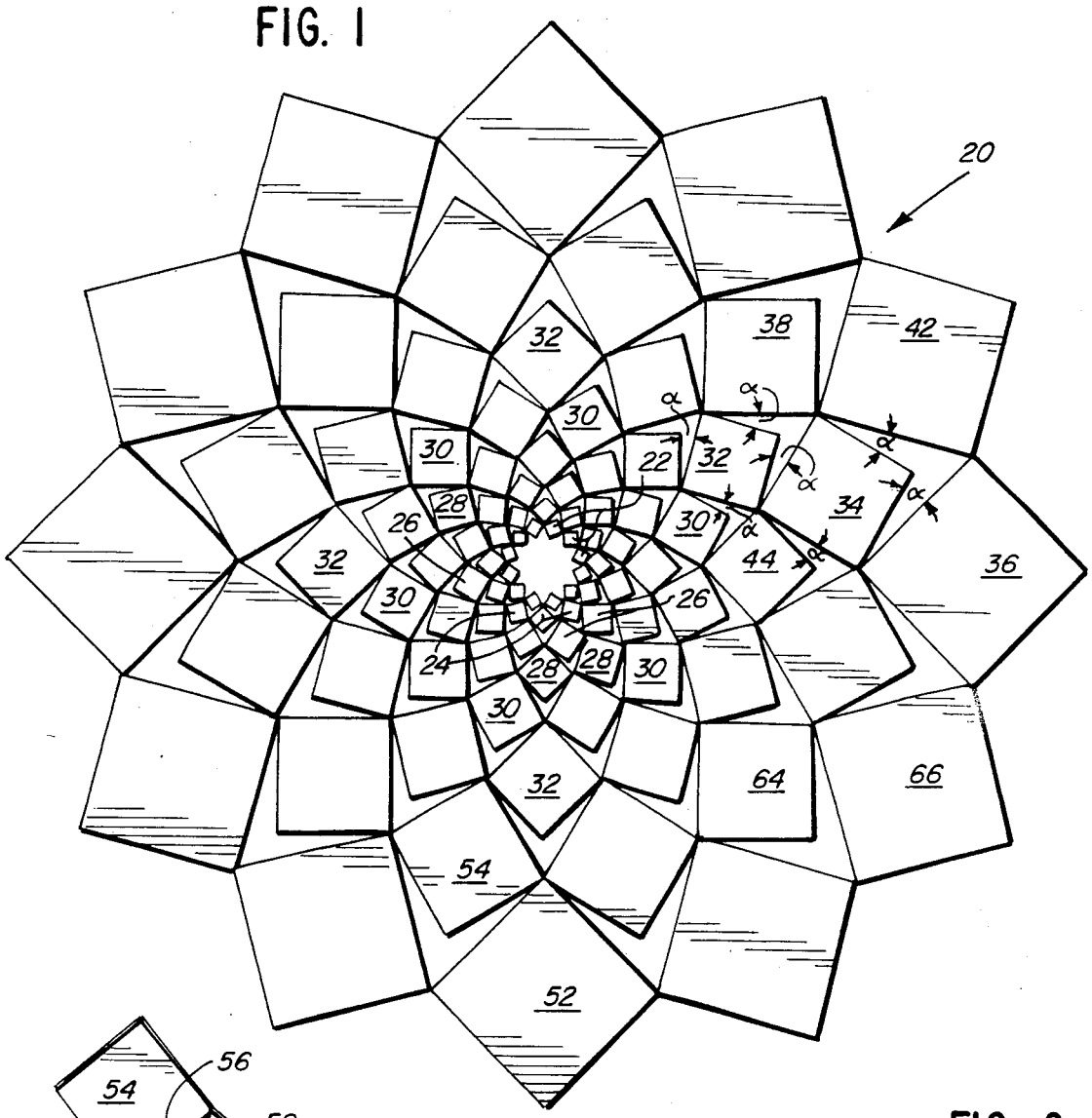
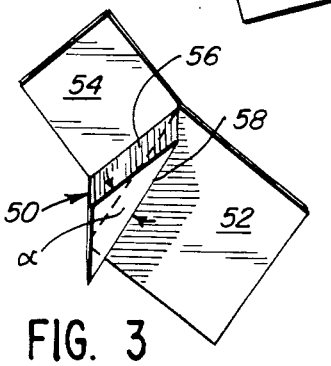
FIG. 3
FIG. 5
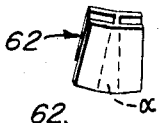
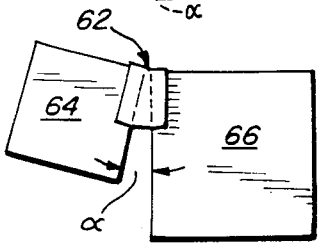
FIG. 6
FIG. 2
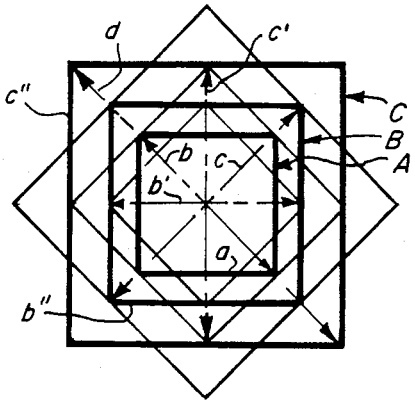

DESIGN GAME AND MODULES FOR USE THEREIN

This application is a continuation of applicant's copending application Ser. No. 611,607, filed May 18, 1984 now abandoned.

FIELD OF INVENTION

This invention relates to a design game, and in particular to such a game in which modules of various carefully defined sizes and employed to produce abstract or quasi-representational designs.

BACKGROUND OF INVENTION

Since ancient times, artists, architects, artisans and other designers have been aware of the aesthetic value of utilizing a series of geometric shapes whose areas are related to each other in accordance with some definite geometric formula. One well known example of the application of this principle is its use in Islamic architecture in the design of various decorative features in a mosque or other structure.

Despite the centuries-old recognition of this aesthetic principle, it appears that the applicability of the principle to a design game has never been recognized. Thus no one, so far as applicant is aware, has ever suggested the desirability or even the possibility of a game that utilizes a plurality of series of pieces or modules in a predetermined total number, with each series containing the same plurality of pieces, all of the pieces having the same predetermined shape, and the size of the pieces in each series progressing in the same way as in every other series, from the smallest of the series to the largest, according to a definite geometric formula.

One prior patent (Adams U.S. Pat. No. 3,698,122) discloses a set of children's playing blocks for making various designs, with the size of the blocks progressing according to a well known geometric formula, but that invention is limited to a single series of blocks and the patent wholly fails to suggest the possibility of employing a plurality of such series to facilitate the production of a wide variety of abstract or quasi-representational designs. The reason for this omission is apparent from the limited educational purpose of the set of blocks disclosed in the patent, which is to illustrate graphically that there are in nature many examples of a nonlinear progression in the size of a series of objects, such as the petals of a daisy, the scales of a pine cone, or the bumps on a pineapple.

For this limited educational purpose, it is not only unnecessary to provide more than a single series of precisely sized blocks, it would in fact defeat the lesson the blocks are designed to demonstrate to an infant or child of tender years if the situation were made more complicated by having two or more blocks of the same size. Thus the Adams invention is inherently restricted to a single series of blocks and necessarily excludes a plurality of series of blocks, which feature is essential to applicant's invention.

SUMMARY OF THE INVENTION

The design game of this invention comprises a predetermined plurality of series of a predetermined plurality of modules, each of which series is constituted of the same number of modules and all of the modules having the same predetermined shape in plan, with the area in plan of the modules of each series of modules progressing in the same way as in every other series, from the smallest of the series to the largest of the series, according to a definite geometric formula. In other words, the various modules of each series of modules have the same physical dimensions, as they progress from the smallest to the largest in the series, as the corresponding modules in every other series have.

Because the modules can be moved about into any position selected by the user of the game except when they may be temporarily secured in place as a part of a desired design, they can be used and re-used over and over to produce various abstract or quasi-representational designs unlimited in number.

So long as the modules are all of the same shape in plan, they may be of any regular or irregular shape desired. In a preferred form, each module has the regular shape of an equilateral polygon in the form of a square. One example of a series of modules in the plurality of series that comprises this invention is a series in which the area in plan of each module in the series is twice as great as the area in plan of the next smaller module of the series.

This harmonic growth pattern can be referred to as a Platonic series of squares, and has also been employed down through the ages by the craft schools of Islamic art and architecture to demonstrate controlled proportional increase or decrease. But, however the pattern is described, so far as is known the pattern has never been applied as applicant applies it in the design game of the present invention.

BRIEF DESCRIPTION OF THE DRAWINGS

This invention will now be described with reference to the attached drawings in which:

FIG. 1 is a plan view of the modules of one embodiment of the design game of this invention arranged in the form of a proportioning diagram such as has been used for centuries in Islamic art and architecture;

FIG. 2 is a diagram showing the development of a series of Platonic squares;

FIG. 3 is a perspective view looking down, from a point slightly off to one side, at a spacer element used to determine the correct positioning of two adjacent modules of the game of this invention;

FIG. 5 is a perspective view, looking down from above, at a spacer element that can be used to determine the proper positioning of adjacent modules and at the same time to provide a temporary attachment of the two modules;

FIG. 6 is a plan view of two modules of the game of this invention with the spacer/attachment element of FIG. 5 in place.

DETAILED DESCRIPTION OF PARTICULAR EMBODIMENTS OF THE INVENTION

Figure 7:
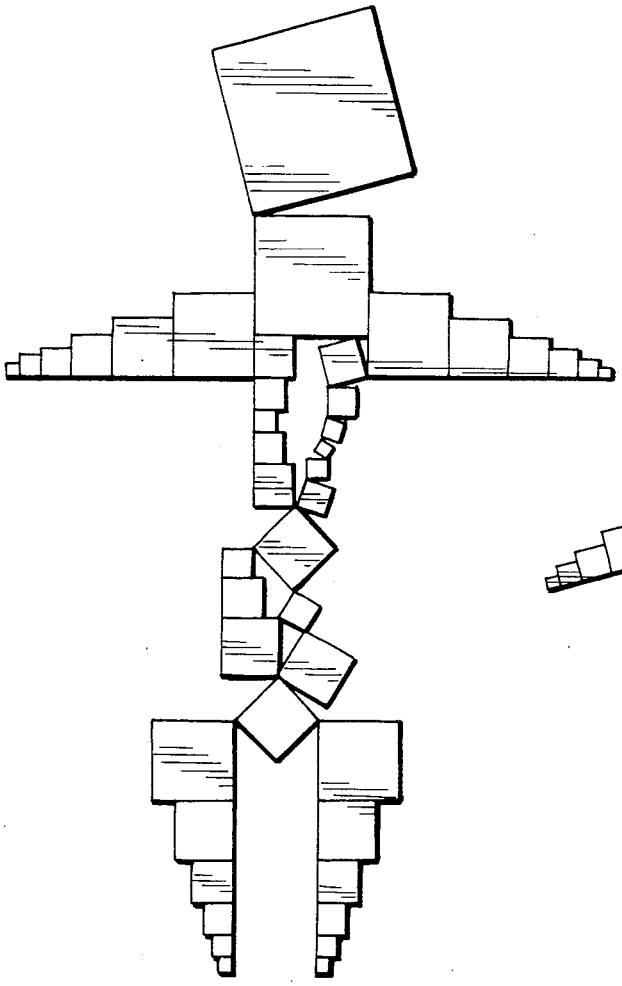
FIGS. 7–10 are examples of quasi-representational figures that can be produced with the design game of this invention.

FIG. 1 shows the modules of design game 20 of this invention arranged in a design reminiscent of the above mentioned proportioning diagram employed by Islamic artists and architects.

The diagram that would correspond to this arrangement of the modules of the game of this invention has been used by Islamic designers for centuries simply as a proportioning diagram to determine the size of various single tiles to be utilized in a desired decorational arrangement. So far as applicant is aware, no complete set of modules in precisely the same sizes and total number of pieces as are illustrated in FIG. 1 has been produced by the Islamic designers referred to that could be arranged (as, for example, in a mosaic) in a design such as shown in that Figure. In any event, all such pieces were of course permanently incorporated in the mural, ceiling panel, or other decorative feature for which they were produced by the artist, architect, designer, or artisan, and were not re-usable in other designs as are the modules of the design game of the present invention.

As will be seen, game 20 is made up of 12 separate and distinct series of modules, with each series including 8 modules. The modules of each series (all of which have the same predetermined shape in plan) are of harmonically increasing size, with the modules progressing from the smallest of the series of the largest of the series according to a definite geometric formula. Thus, one series of modules includes the smallest module 22, the mext larger module 24, the next larger module 26, and successively larger modules 28, 30, 32, 34 and 36.

Each pair of adjacent modules of harmonically increasing size in a given series is positioned with the same angle $\alpha$ enclosed by the pair. Hence the modules of each successive pair in a given series—such as 30/32, 32/34 and 34/36—are separated by the same angle $\alpha$.

One other spatial relationship that obtains in the arrangement of FIG. 1 is that any given module of a series is positioned at the same angle $\alpha$ with respect to two adjacent modules of a larger and smaller size that are located in a series of modules lying on either side of the given module.

Thus, in FIG. 1 module 32 is positioned at angle $\alpha$ with respect to module 38 of the series of modules directly above the series of which module 32 is a member, and at the same angle $\alpha$ with respect to module 40 of the series of modules that lies directly below the series of which module 32 is a member. Similarly, module 34 is positioned at angle $\alpha$ with respect to larger module 42 of an adjacent series, and at the same angle $\alpha$ with respect to smaller module 44 of the series of modules on the other side of module 34.

As stated above, the embodiment of the game of this invention shown in FIG. 1 includes 12 series of modules, and each series contains 8 modules of harmonically related size. As shown, in this embodiment each module is square in shape. The side of each square is harmonically larger than its predecessor by the square root of 2, or approximately 1.414214. Thus, the area of module 24 is two times (i.e., 1.414214 squared) the area of module 22, the area of module 26 is two times the area of module 24, and so forth through the series of modules of progressively increasing size up to and including module 36.

In the embodiment of FIG. 1, the angle $\alpha$ (discussed above) between pairs of adjacent modules is 15°.

Table I below shows the relationship between the sides of each square and the sides of the two adjacent squares in a given series selected according to the proportioning diagram to which the embodiment of FIG. 1 corresponds, when the number of series of modules is a number from 5 through 20. The applicable figures for such an embodiment when the number of series of modules is 12 (as in the embodiment of FIG. 1) are set off for emphasis in the Table. The fractional portion of each ratio of the respective sides of adjacent square modules is indicated in six significant figures, and the fractional portion of each angle is indicated in three significant figures.

TABLE I

| No. Of Series Of Modules | Degrees Of Angle Between Modules | Ratio With Side Of Larger Module | Ratio With Side Of Smaller Module |
|---|---|---|---|
| 5 | 36.000 | 0.221232 | 4.520147 |
| 6 | 30.000 | 0.366025 | 2.732051 |
| 7 | 25.714 | 0.467035 | 2.140937 |
| 8 | 22.500 | 0.541196 | 1.847759 |
| 9 | 20.000 | 0.597672 | 1.673157 |
| 10 | 18.000 | 0.642040 | 1.557537 |
| 11 | 16.364 | 0.677760 | 1.475448 |
| 12 | 15.000 | 0.707107 | 1.414214 |
| 13 | 13.846 | 0.731626 | 1.366818 |
| 14 | 12.857 | 0.752407 | 1.329068 |
| 15 | 12.000 | 0.770236 | 1.298304 |
| 16 | 11.250 | 0.785695 | 1.272759 |
| 17 | 10.588 | 0.799224 | 1.251214 |
| 18 | 10.000 | 0.811160 | 1.232303 |
| 19 | 9.474 | 0.821767 | 1.216890 |
| 20 | 9.000 | 0.831254 | 1.203002 |

The dimensions for the modules of progressively and harmonically increasing size such as modules 22 through 36 of the embodiment of FIG. 1 can be determined by an alternative method based on the Platonic series of squares. FIG. 2 provides a diagram showing the development of a series of Platonic squares, each one of which squares has an area that is twice as great as the area of the preceding square in the series, as will be seen by squaring the FIG. 1.414214 (the square root of 2) that is included in the fourth column of Table I above as a part of the information applicable when the number of series of modules (as in FIG. 1) is 12.

In this diagram, squares A, B and C are progressively larger squares. The area of a given square is 2 times the area of the next smaller square. In this Figure, side a of square A is taken as one unit, which makes the area of this square one square unit. When diagonal b of square A is rotated 45° counterclockwise to position b′ and moved downward to the position of side b″, this makes the side of square B 1.414214 times the length of side a of square A. The area of square B is therefore 2 square units, or twice the area of square A.

Continuing the progression, if diagonal c of square B is moved 45° counterclockwise into position c′ and then moved to the left to the position of side c″, the side of the resulting square C is 1.414214 times the length of side b″ of square B, which makes the area of square C twice the area of square B, or 4 square units. Diagonal d of square C (the length of which is the square root of 2 times the length of side c″ of square C) then determines the length of the side of the next larger square (not shown), and when this dimension is squared the area of the next larger square is seen to be twice that of square C.

Figure 4:
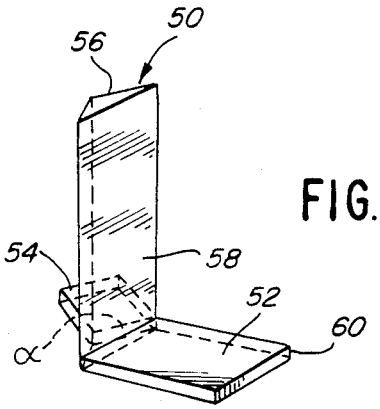
FIG. 4 (on the second sheet of drawings) is a perspective view, from one side, of the modules and spacer element of FIG. 3.
Figure 9:
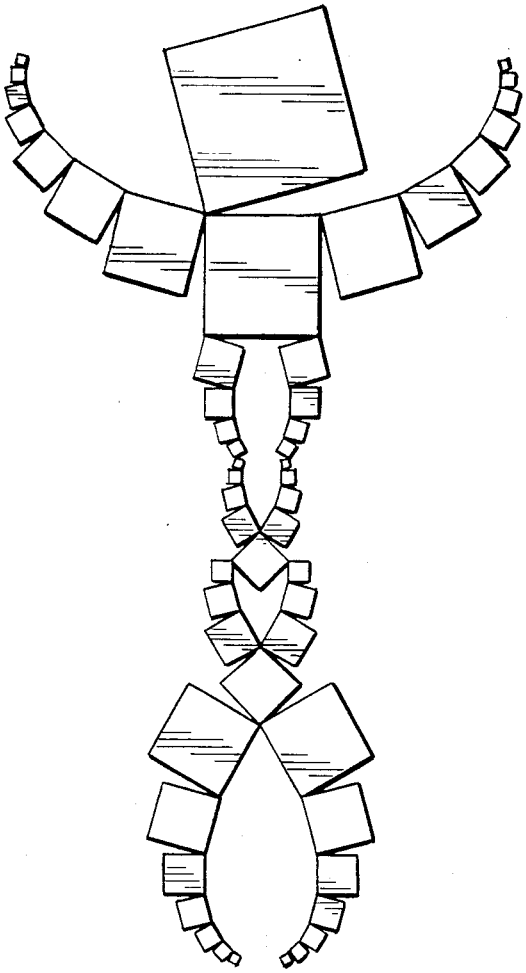

FIG. 3 provides a perspective view from the top of spacer element 50 in position between modules 52 and 54 of game 20 illustrated in FIG. 1, and FIG. 4 (on the second sheet of drawings) gives a perspective view, from the side, of the spacer element. As seen in these two views, spacer 50, whose vertical sides 56 and 58 form angle $\alpha$, automatically positions modules 52 and 54 with the proper angle between them.

If one of the abstract geometric figures to be formed with this design game is to be the pattern illustrated in FIG. 1, the angles between adjacent modules must be the predetermined angle $\alpha$ shown in Table I above. If desired, however, the predetermined angle $\alpha$ for positioning adjacent modules may be selected as a different value even though the number of modules in a series and the number of series of modules that make up the game is not changed. In that case, the set of modules that make up the game of this invention will not fit evenly within a circular perimeter, as it does when arranged in the same pattern as the proportioning diagram to which FIG. 1 corresponds or when any other set of modules is designed according to the dimensions and respective angles given in Table I above.

FIG. 4 shows module 52 to have a relatively low height 60. In the embodiment of the invention shown in FIG. 1, the height of each module is the same as that of all of the other modules. Each module has a planar bottom surface, and the top surface of each module bears the same relationship to the bottom surface as in every other module. If desired, the modules of the game of this invention may be of a greater height than is indicated in FIG. 4, so long as the module bottom and top surfaces bear the same relationship to each other in every module.

In the embodiment of FIG. 1, the top and bottom surfaces of each module are parallel to each other, and the modules are formed of cardboard, plastic, wood or any suitable material.

FIG. 5 shows a spacer element 62 in a perspective view from the top, that can be used both to determine the proper positioning of adjacent modules and at the same time to provide a temporary attachment of the two modules. FIG. 6 shows a plan view of two modules 64 and 66 of game 20 that are both positioned and temporarily attached by spacer/attachment element 62. As is seen from FIGS. 5 and 6, modules 64 and 66 are positioned automatically with angle $\alpha$ between them.

As has been stated above, the modules of the design game of this invention can be employed to form any desired graphic design, whether an abstract design or a quasi-representational design. The number of abstract designs such as illustrated in FIG. 1 that can be formed with this game is unlimited. The number of quasi-representational designs that can be formed with the design game of this invention is likewise unlimited.

Figure 8:
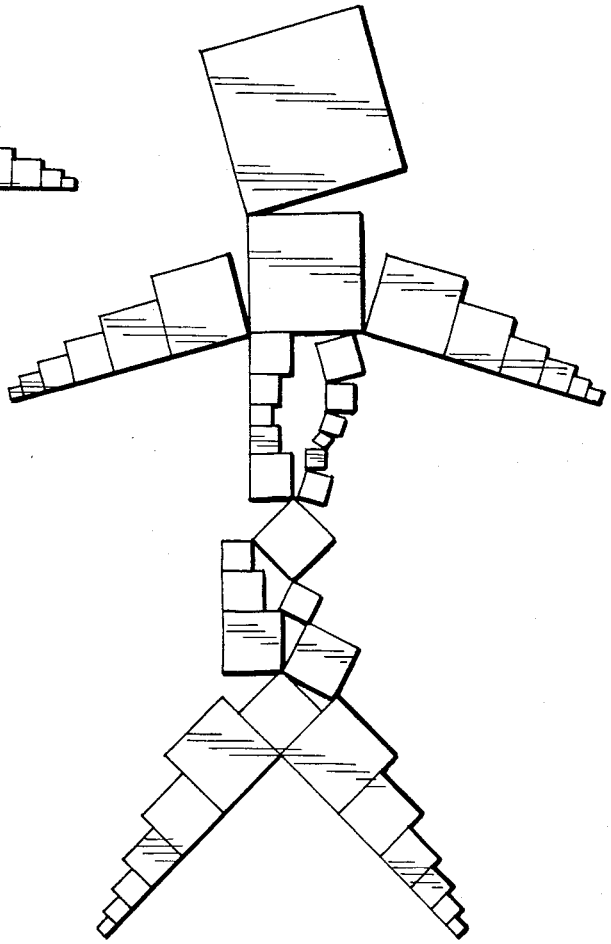

In FIGS. 7–10, four designs that suggest human figures are shown. The designs of FIGS. 7 and 8 are formed from games that include at least 10 series of modules, each of which series includes at least 8 modules of progressively and harmonically increasing size. The designs of FIGS. 9 and 10 have been made from games that include at least 10 series of modules, each of which series contains at least 9 modules of similarly increasing size.

As will be seen from the statements in the preceding paragraph and from the discussion below in this specification, in any given game of this invention the predetermined number of series of modules (which number may be called the "first predetermined plurality" of series) may be, as desired, either the same as or different from the predetermined number of modules in each series (which number may be called the "second predetermined plurality" of modules).

The design game of this invention lends itself not only to the production of a static design (whether abstract or quasi-representational), but also to the production of a series of designs each of which designs differs only slightly from the preceding one in a manner such that the series can be photographed sequentially to produce an animated motion picture film. When a series of designs of this type is photographed with a motion picture camera, the small changes in the successive frames of the resulting film will produce in the observer's eye and mind an image of movement in the same way that animated cartoons have produced the illusion of movement for many years.

Figure 10:
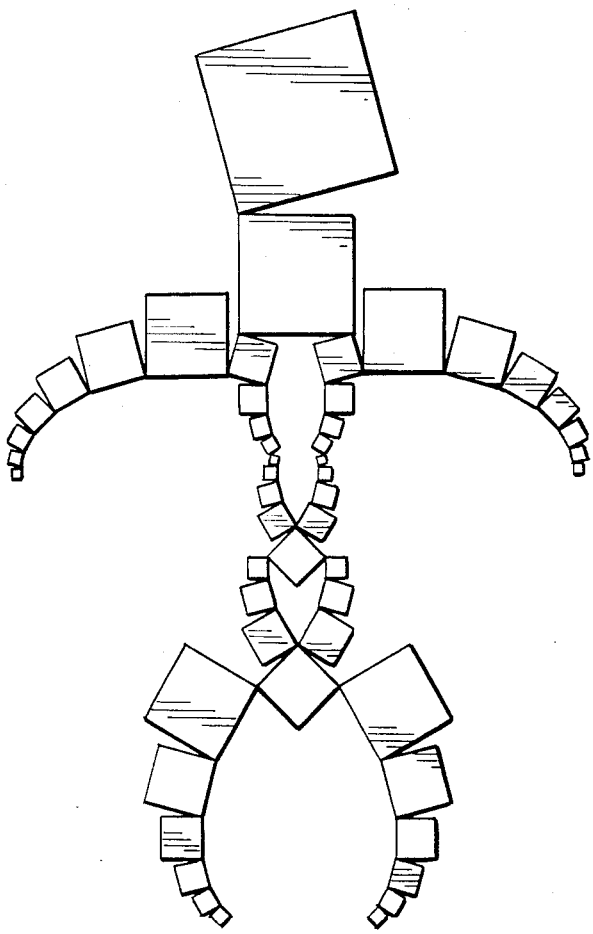

An example of two possible designs in a series of designs to be used in the production of an animated film in the manner described—which two designs would have several related designs between them that differ from each other only by quite small increments in the positioning of the modules of the design—is provided by the arrangements of modules suggesting a human figure that are illustrated in FIGS. 7 and 8. Another example of two possible designs that—together with a number of other slightly different designs lying between them—could be used in the production of an animated film is provided by the arrangements of modules suggesting the hips and the legs of a human figure that are illustrated in FIGS. 7 and 10.

If desired, instructions for the positioning of the modules in a series of slightly different arrangements of modules that are to be photographed sequentially for an animated film in the manner just explained can be produced, as is commonly done for animated cartoon films, through the use of a conventional computer programming technique.

In design game 20 illustrated in FIG. 1 and in the design games whose modules have been disposed in the patterns shown in FIGS. 7–10, each module has a predetermined regular shape in the form of an equilateral polygon of four sides with each pair of adjacent sides enclosing a right angle, or in other words a square. The modules of the game of this invention need not be in this particular form, but may be, for example, circles, triangles, pentagons, or any other desired regular or irregular shape so long as the other limitations of the invention as defined in the claims are met.

To add to the variety of the design game of this invention, the top surface of each module in any given series may be of one color, with that color being different from the color of the top surface of the modules in every other series.

In addition to the embodiments of the game of this invention illustrated in FIG. 1, in which the area in plan of each module in a given series is twice as great as the area in plan of the next smaller module of the series, the areas of successive modules in a series may vary in accordance with any other definite geometric formula.

Thus, for example, the area in plan of the modules in a given series in the game of this invention may progress from the smallest module to the largest module in accordance with the well known Fibonacci series. In a game comprising such modules, the progressive relationship of size of the modules in a given series would follow the sequence described by Leonardo Fibonacci of Pisa in the 13th century. The Fibonacci series is a sequence produced by starting with the numeral 1 and adding the last two numbers to arrive in each case at the next number. In other words, the area of the modules in each series would progress according to the sequence of 1, 1, 2, 3, 5, 8, 13, 21, 34, etc. The ratio between any two adjacent Fibonacci numbers after 3 is about 1:1.618.

A virtually identical proportion is provided by the "golden section," or extreme and mean ratio, which is believed to have been discovered by the Greeks in the 5th century B.C. The main measurements of many buildings of antiquity and of the Middle Ages follow a definite proportion, and those of the Parthenon on the Acropolis of Athens are governed by the golden section. In the application of this principle, the division of a length—such as the division of the length of the side of one square in a given series of modules in the design game of this invention to determine the length of the side of the preceding square in the series—is made so that the smaller part is to the greater as the greater is to the whole. The golden section is a frequent norm for modern industrial design, as it is generally considered to be pleasing and harmonious to the human eye.

Any other definite geometric formula that produces a harmonic relationship between the successive modules of the game of this invention as they progress from the smallest of a given series to the largest of that series may be employed to advantage, with resulting pleasing aesthetic effect in the abstract or quasi-representational designs that can be developed with the game.

The following guide lines for selection of the parameters for any particular embodiment of the design game of this invention should be kept in mind:

1. The plurality of modules in each series may be any whole number desired. In general, however, the number should be large enough to provide flexibility in the potential designs that can be produced with the game, yet not so large as to produce an inconvenient number of pieces.

2. Similarly, the plurality of series may be any whole number desired. Again, however, the number of module series should be large enough to provide flexibility of design, but not so large as to make the game unwieldy.

3. To effectuate the goals mentioned in guide lines 1 and 2, the number of modules per series is preferably at least about six, and the number of series is preferably also at least about six.

4. In addition to guide lines 1–3, attention should also be paid—regardless of what geometric formula is employed to produce modules of harmonically and progressively increasing size—to making the difference between the sizes of successive modules large enough that a pleasing variety of sizes will result, with substantial aesthetic contrast between adjacent modules in any given series.

5. On the other hand, the difference between the sizes of successive modules in a series should be small enough that a wide selection of sizes, from the smallest to the largest size, will be available in each series of modules.

It is believed that this design game succeeds in producing pleasing aesthetic results because it utilizes basic geometric rules involving proportion, rates of change, sequence, proportional interaction, extrapolation, and (in certain designs) a fixed angular relationship between solid pieces of carefully defined sizes and the voids or unfilled spaces between those pieces.

The mathematical principles utilized in this invention have been known since the evolution of geometry, but so far as is known these basic principles have never been utilized to develop the full principles of the inherent aesthetic and proportional values that are present in the design game defined by the appended claims, to permit the user to create an unlimited number of pleasing designs through continued use and re-use of the modules that make up this game.

The above detailed description has been given for clearness of understanding only. No unnecessary limitations should be understood therefrom, as modifications will be obvious to those skilled in the art.

I claim:

1. A design game for producing various abstract or quasi-representational designs which comprises a first predetermined plurality, and no more than said first predetermined plurality, of series of a second predetermined plurality, and no more than said second predetermined plurality, of modules, each of said series being constituted of the same number of modules, each of said series of modules including at least six modules and the game including at least six such series, said game including no more modules than those just described, all of said modules having the same predetermined shape in plan, the area in plan of the modules in any given series of modules progressing from the smallest of the series to the largest of the series according to a definite geometric formula, the various modules of each of said series of modules having the same physical dimensions as they progress from the smallest to the largest in the series as the corresponding modules in every other series have, all of said modules being free to be moved about into any position selected by the user of the game unless temporarily secured in place by the user as a part of a desired design.

2. The design game of claim 1 in which said predetermined shape in plan of said modules is a regular shape.

3. The design game of claim 2 in which said predetermined shape is an equilateral polygon.

4. The design game of claim 3 in which said predetermined regular shape is a square.

5. The design game of claim 1 in which the area in plan of each of said modules in a given series is twice as great as the area in plan of the next smaller module of said series.

6. The design game of claim 1 in which each of said modules has a planar bottom surface and the top surface of each module bears the same relationship to the bottom surface as in every other module.

7. The design game of claim 1 in which all of said modules have the same vertical dimensions.

8. The design game of claim 2 which includes at least one spacer element for positioning one of said modules adjacent another with a predetermined angle included between the sides of said two modules when thus positioned.

9. A design game for producing various abstract or partially representational designs which comprises:

(a) a first predetermined plurality, and no more than said first predetermined plurality, of series of a second predetermined plurality, and no more than said second predetermined plurality, of modules, each of said series being constituted of the same number of modules, each of said series of modules including at least six modules and the game including at least six such series, said game including no more modules than those just described, all of said modules having the same predetermined regular shape in plan and the same vertical dimensions, the area in plan of the modules in any given series of modules progessing, from the smallest of the series to the largest of the series, according to a definite geometric formula with the area in plan of each of said modules in a given series being twice as great as the area in plan of the next smaller module of said series, the various modules of each of said series of modules having the same physical dimensions as they progess from the smallest to the largest in the series as the corresponding modules in every other series have; and (b) at least one spacer element for positioning one of said modules with respect to another with a predetermined angle included between the sides of adjacent modules when thus positioned, all of said modules being free to be moved about into any position selected by the user of the game unless temporarily secured in place by the user as a part of a desired design.

10. A combination of various modules from the design game of claim 1 that is arranged in a pattern that suggests a living being.

11. The combination of claim 10 that is arranged in a pattern that suggests a human figure.

* * * * *